106-75 AU 115 EX
4/18/78 X2 4,085,235

United States Patent [19]

Compen

[11] 4,085,235

[45] Apr. 18, 1978

[54] METHOD OF MANUFACTURING A CATHODE-RAY TUBE

[75] Inventor: Johannes Maria Azalina Antonius Compen, Eindhoven, Netherlands

[73] Assignee: U.S. Philips Corporation, New York, N.Y.

[21] Appl. No.: 740,256

[22] Filed: Nov. 10, 1976

[30] Foreign Application Priority Data

Nov. 19, 1975 Netherlands ..... 7513490

[51] Int. Cl.[2] ..... H01J 29/88

[52] U.S. Cl. ..... 427/64; 427/106; 427/122; 427/372 B; 106/75; 106/84; 252/502; 252/510

[58] Field of Search ..... 427/64, 226, 229, 67; 427/372 B, 122, 106; 106/75, 84; 252/502, 509, 510, 511

[56] References Cited

U.S. PATENT DOCUMENTS

| | | | |
|---|---|---|---|
| 2,462,763 | 2/1949 | Nightingall | 427/372 B |
| 3,518,116 | 6/1970 | Stock | 427/64 X |
| 3,947,608 | 3/1976 | Duinker et al. | 427/64 |

FOREIGN PATENT DOCUMENTS

| | | | |
|---|---|---|---|
| 6,610,613 | 1/1968 | Netherlands | 427/64 |

*Primary Examiner*—Ralph S. Kendall
*Attorney, Agent, or Firm*—Frank R. Trifari

[57] ABSTRACT

A suspension comprising electrically conductive material, a binder, and from 3% to 30% by weight of sodium carbonate or potassium carbonate is applied to a wall portion of a cathode-ray tube and then dried and fired. This provides a layer in which hardly any bubbles have formed during the firing of the cathode-ray tube and which during firing produces no gases which detrimentally influence the emission of the cathode.

9 Claims, 1 Drawing Figure

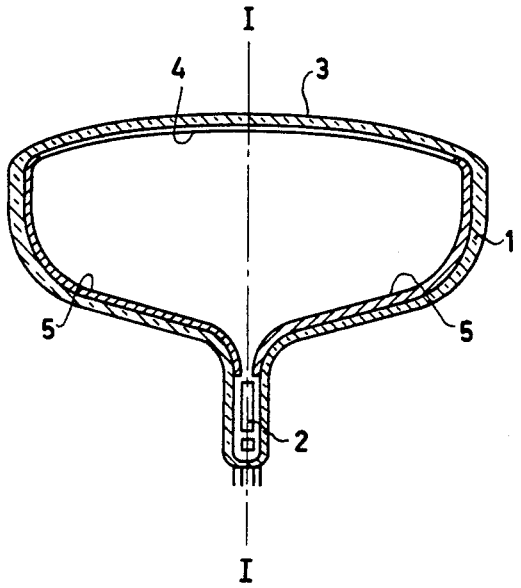
I
4
3
1
5
5
2
I

METHOD OF MANUFACTURING A CATHODE-RAY TUBE

The invention relates to a method of manufacturing a cathode ray tube, the method including the step of making an electrically conductive layer on an internal wall portion of the cathode-ray tube, by applying a coating of a suspension comprising an electrically conductive material, a binder, and sodium carbonate or potassium carbonate or both, to the internal wall portion, after which the coating of the said suspension is dried and fired. The invention also ralates to a cathode-ray tube manufactured by such a method.

A prior method of manufacturing an electrically conductive layer on an internal wall portion of a cathode-ray tube is disclosed in U.S. Pat. No. 3,947,608. A cathode-ray tube manufactured according to this known method comprises in an evacuated envelope an electrode configuration for generating one or several electron beams, a display screen on an internal wall portion of the envelope, and the said electrically conductive layer. In such cathode-ray tubes said layer is obtained by applying a coating of the suspension to an internal part of the wall of the cathode-ray tube by means of a brush, by pouring or by spraying. The coating is then dried and the envelope is fired. In most of the cases said layer forms a conductive layer between an anode of the said electrode configuration and the display screen. The latter serves as a target for the said electron beams and hence performs the function of a second anode. An electrical connection is often made to the anode of the said electrode configuration via a lead-through in the tube wall of the cathode-ray tube and the said layer. The object of the said layer is to create a field-free space in a region of the cathode-ray tube where the electron beams will not be deflected. The said layer is usually dull black so as to provide good radiation of thermal energy.

An important desired property of the said electrically conductive layer is that during assembly and operation of the cathode-ray tube few or no parts of the material of the layer should separate therefrom. Such separate parts of the material may be formed, for example, in that during assembly gas bubbles which are formed in the layer during firing are crushed. Said separate parts may interrupt the path of the said electron beams and thus cause picture defects. Breakdowns and short-circuits caused by said separate particles may also be caused in the said electrode configuration. According to U.S. Pat. No. 3,947,608, the behaviour of the said layer may be influenced by adding to the suspension alkali metal sulphates or ammonium sulphate or alkali metal nitrates or ammonium nitrate so that improved adhesion, hardness and resistance to shrinkage and detrition are achieved. It has been found, however, that during operation of the cathode-ray tube gases can be liberated from the layer which can have a detrimental influence on the electron emission of the cathode in that the emissive material is attacked. Said emissive material usually consists of a mixture of two or more alkaline earth metal oxides. It has been found in addition that after a number of hours of operation, the electrodes show sometimes oxidation spots. The said sulphates and nitrates are suitable for use in the conductive layer, but preferably not in the whole layer.

It is an object of the invention to provide an improved method of manufacturing an electrically conductive layer on an internal wall portion of a cathode-ray tube. Another object of the invention is to obtain a layer which does not produce separate particles in the cathode-ray tube both during operation and during the assembly of said cathode-ray tube and in which there is no risk that the cathode and other electrodes are attacked during operation of the cathode-ray tube. A third object of the invention is to provide an addition for the said suspension which influences the adhesion, hardness and flexibility of the said layer and in addition prevents the formation of bubbles in the layer during firing the cathode-ray tube.

According to the invention, a method of the kind mentioned in the first paragraph is characterized in that the sodium carbonate ($Na_2CO_3$) and/or potassium carbonate ($K_2CO_3$) and represents from 3 to 30% by weight of the total of suspended and dissolved solids of the said suspension. The binder may be an alkali metal silicate or nitrocellulose.

The recognition in the mechanism which occurs in the use of the carbonate-containing suspension is not complete. What is found is that the layer has an elastic character and a more or less porous structure so that the formation of gas bubbles during the firing of the layer is prevented. Moreover, during operation of the cathode-ray tube no gases are formed which have a detrimental influence on the electron emission of the cathode-Ammonium carbonate was found to be unsuitable since it causes the suspension to flocculate in contrast with ammonium nitrate which is mentioned U.S. Pat. No. 3,947,608.

In a method of manufacturing an electrically conductive layer on an internal wall portion of a cathode-ray tube the carbonate in the suspension is preferably sodium carbonate. Good results are obtained when from 3 to 30% by weight of the solid part of the said suspension consists of sodium carbonate or potassium carbonate. There is an optimum effect when from 16 to 20% by weight of the solid part of the said suspension is sodium carbonate. The operation is better than, for example, when 4% by weight of sodium nitrate in the solid part of the suspension is used as is stated in the U.S. Pat. No. 3,947,608, while in addition the emission is not detrimentally influenced during operation of the cathode-ray tube.

An embodiment of the invention will now be described in greater detail with reference to the FIGURE of the accompanying drawing which is a sectional elevation of a cathode-ray tube manufactured by a method of the invention.

The cathode-ray tube comprises an envelope 1 in which an electrode configuration 2 for generating at least one electron beam, a display screen 3 built up of a luminescent layer 4 and an electrically conductive layer 5 on the inner wall of the envelope 1. I—I is the axis of the cathode-ray tube. The electrically conductive layer can be obtained, for example, as follows.

EXAMPLE

An aqueous suspension is obtained by thoroughly mixing 20 - 30% by weight of graphite powder as a conductive layer, 10 - 15% by weight of potassium silicate, as a binder, and 6% by weight of sodium carbonate and was made up to 100% with water. A coating of the resulting suspension was applied on a part of the inner wall of the envelope by means of a brush, by spraying or pouring. The layer was then dried after which the envelope traversed a temperature track in a furnace in which temperatures up to 450° C occur. The layer was thereby hardened and caused to ashere to the surface of the envelope, showed nearly no unevennesses caused by gas bubbles in the layer, and had a sufficiently great flexibility so that during assembly and operation of the cathode-ray tube no separate particles were formed in said cathode-ray tube.

The following Table shows the influence of the quantities by weight of sodium carbonate or potassium carbonate in % by weight of the solid part of the suspension on the formation of bubbles in the coating layer.

TABLE

| % by weight of $Na_2CO_3$ | bubbles in the coating layer | % by weight of $K_2CO_3$ | bubbles in the coating layer |
|---|---|---|---|
| 0 | very many | 0 | very many |
| 3 | a few | 3 | a few |
| 12 | hardly any | 12 | a few |
| 18 | hardly any | 18 | hardly any |
| 24 | hardly any | 24 | hardly any |
| 30 | hardly any | 30 | hardly any |

It has been found that if from 3 to 30% by weight of the solid part of the suspension is sodium carbonate or potassium carbonate a few to hardly any bubbles occur in the layer.

The best result is achieved with 18% by weight of sodium carbonate. When more than 30% by weight of carbonate are added it is found that the suspension is difficult to process.

It will be obvious that in the suspension potassium carbonate may also be used instead of sodium carbonate.

What is claimed is:

1. A method of forming an electrically conductive layer on an internal wall portion of a cathode-ray tube envelope, said method comprising the steps of:

applying to said wall portion a coating of an aqueous suspension comprising an electrically conducting material, a binder from the group consisting of alkali metal silicate and nitrocellulose, and one or a mixture of more than one alkali carbonate from the group consisting of sodium carbonate and potassium carbonate, the total quantity of alkali carbonate being between approximately 3% and 30% by weight of the total weight of suspended and dissolved solids in said suspension;

drying said suspension on said wall portion; and firing said envelope.

2. The method as defined in claim 1 in which said alkali carbonate is sodium carbonate and the total quantity of sodium carbonate is between 3% and 30% by weight of the total weight of suspended and dissolved solids in said suspension.

3. The method as defined in claim 2 in which the total quantity of sodium carbonate is between 16% and 20% by weight.

4. The method as defined in claim 3 in which the total quantity of sodium carbonate is 18% by weight.

5. The method as defined in claim 1 in which said alkali carbonate is potassium carbonate and the total quantity of potassium carbonate is between 3% and 30% by weight of the total weight of suspended and dissolved solids in said suspension.

6. The method as defined in claim 5 in which said potassium carbonate is between 18% and 30% by weight.

7. The method as defined in claim 1 in which said electrically conductive material is graphite powder.

8. The method as defined in claim 1 in which said envelope is fired at a temperature of 450° C.

9. A method of forming an electrically conductive layer on an internal wall portion of a cathode-ray tube envelope, said method comprising the steps of:

thoroughly mixing 20% to 30% by weight of graphite powder as an electrically conductive material, 10% to 15% by weight of potassium silicate as a binder, 6% by weight of sodium carbonate, and the remainder of the total weight of water to form a suspension;

applying said suspension to said internal wall portion to form a layer thereon;

drying said layer; and firing said envelope at approximately 450° C.

* * * * *